US012721455B2

(12) United States Patent
Kish

(10) Patent No.: US 12,721,455 B2
(45) Date of Patent: Sep. 1, 2026

(54) RECORD HOLDER

(71) Applicant: PROLIFICO LLC, Saint Clair Shores, MI (US)

(72) Inventor: Jason Kish, Saint Clair Shores, MI (US)

(73) Assignee: PROLIFICO LLC, Saint Clair Shores, MI (US)

( * ) Notice: Subject to any disclaimer, the term of this patent is extended or adjusted under 35 U.S.C. 154(b) by 0 days.

(21) Appl. No.: 18/537,172

(22) Filed: Dec. 12, 2023

(65) Prior Publication Data

US 2024/0188733 A1 Jun. 13, 2024

Related U.S. Application Data

(60) Provisional application No. 63/386,989, filed on Dec. 12, 2022.

(51) Int. Cl.
*A47F 7/00* (2006.01)
*A47G 1/16* (2006.01)

(52) U.S. Cl.
CPC ..... *A47F 7/0042* (2013.01); *A47G 1/16* (2013.01)

(58) Field of Classification Search
CPC ..... A47F 7/0042; A47F 7/0246; A47G 1/16; A47G 1/1646; F16B 2/12; F16B 2/06; F16M 11/041; H05K 5/0204
USPC ... 248/475.1, 669, 316.4, 316.6, 307, 309.1, 248/346.04, 490, 491; 40/742, 792
See application file for complete search history.

(56) References Cited

U.S. PATENT DOCUMENTS 806,321 A * 12/1905 Clark ..... A47G 1/1646 248/490
1,056,636 A * 3/1913 Davison ..... A47G 1/1646 248/491
1,884,370 A * 10/1932 Swanson ..... G01L 27/00 248/316.4

(Continued)

FOREIGN PATENT DOCUMENTS

AU 2021100517 A4 4/2021
DE 1141092 B 12/1962
WO 2017/132632 A1 8/2017

OTHER PUBLICATIONS

CollectorMount Album Mount on Amazon https://www.amazon.com/CollectorMount-Album-Record-Invisible-Adjustable/dp/B00IBZ1CDK (last accessed Nov. 6, 2023).

(Continued)

*Primary Examiner* — Ingrid M Weinhold
(74) *Attorney, Agent, or Firm* — The Dobrusin Law Firm, P.C.; Daniela M. Thompson-Walters

(57) ABSTRACT

A holder for displaying content, the holder comprising: a) an upper member having an upper channel along at least a portion of a top peripheral edge; b) a lower member having a lower channel along at least a portion of a bottom peripheral edge; wherein the lower channel is located opposite from the upper channel; wherein a distance from the lower channel to the lower channel forms a holding gap configured to receive the content for display; and wherein the upper member is moveable relative to the lower member or vice-versa such that the upper channel moves further away from the lower channel or vice-versa and the holding gap is increased in size.

19 Claims, 8 Drawing Sheets

(56) References Cited

U.S. PATENT DOCUMENTS 2,042,768 A * 6/1936 Bruns ..... B60R 13/105 248/316.4
2,632,971 A * 3/1953 Manczek ..... A47G 1/142 248/491
2,695,473 A * 11/1954 Lynch ..... A47G 1/1646 248/491
3,590,510 A * 7/1971 Salz ..... A47G 1/00 40/739
3,797,799 A * 3/1974 Maggia ..... A47G 1/0638 248/491
4,055,319 A * 10/1977 Pendock ..... A47G 1/0644 248/491
4,118,003 A * 10/1978 Dillow ..... F16M 13/022 248/539
4,223,864 A * 9/1980 Harlow ..... A47G 1/1646 248/490
4,230,330 A * 10/1980 Muhammad ..... A63C 17/01 280/87.042
4,368,585 A * 1/1983 Meltzer ..... A47G 1/1646 40/661.05
4,457,484 A * 7/1984 Hameister ..... A47G 1/1646 248/490
4,687,169 A * 8/1987 Thomas ..... A47G 1/1646 248/490
5,014,955 A * 5/1991 Thompson ..... B63B 32/83 441/74
5,454,539 A * 10/1995 Lafontaine ..... A47G 1/1646 248/490
6,370,741 B1 * 4/2002 Lu ..... A47B 21/045 24/523
6,585,212 B2 * 7/2003 Carnevali ..... B60R 11/0252 312/319.1
6,942,094 B2 * 9/2005 Coulson ..... A63C 11/02 248/316.4
7,551,458 B2 * 6/2009 Carnevali ..... H04M 1/04 361/807
7,823,844 B2 * 11/2010 Carnevali ..... B25B 5/02 248/176.1
7,837,166 B2 * 11/2010 Liao ..... F16M 13/00 24/523
8,091,850 B2 * 1/2012 Carnevali ..... B60R 11/0252 248/176.1
8,667,721 B2 3/2014 Heeps
8,833,716 B2 * 9/2014 Funk ..... F16M 13/022 248/316.4
9,038,976 B2 * 5/2015 Leet ..... A63C 11/028 248/316.4
9,108,096 B2 * 8/2015 Solheim ..... A63B 69/3632
9,115,740 B2 * 8/2015 Chang ..... F16M 11/043
9,139,358 B2 9/2015 Levitan
9,356,640 B2 5/2016 Lambert
9,578,979 B1 * 2/2017 Zeuch ..... F16M 13/02
9,581,180 B2 * 2/2017 Lien ..... F16B 2/10
9,648,968 B1 5/2017 Alme
9,776,577 B2 * 10/2017 Carnevali ..... F16M 11/041
10,251,496 B1 * 4/2019 Zeuch ..... A47G 1/215
10,626,899 B2 * 4/2020 Lien ..... H04M 1/11
10,637,980 B1 * 4/2020 Nawas ..... F16M 11/041
11,363,895 B2 * 6/2022 Schuft ..... A47F 7/0246
D1,056,100 S * 12/2024 Signorelli ..... D21/753
12,163,618 B2 * 12/2024 Lin ..... F16M 11/041
2004/0026590 A1 * 2/2004 Lin ..... A47B 23/04 248/346.04
2005/0205742 A1 * 9/2005 Kixmoeller ..... A47J 47/16 248/490
2014/0042285 A1 * 2/2014 Carnevali ..... F16M 11/041 248/316.4
2015/0060624 A1 * 3/2015 Huang ..... F16M 11/105 248/316.4
2015/0192155 A1 * 7/2015 Chen ..... F16M 11/38 348/376
2015/0359114 A1 * 12/2015 Yang ..... F16M 11/04 248/161
2016/0018050 A1 * 1/2016 Solheim ..... A63B 69/3632 248/316.4
2017/0350555 A1 * 12/2017 Jertson ..... F16M 11/16
2019/0145444 A1 * 5/2019 Lien ..... H04M 1/04 24/490
2022/0120379 A1 * 4/2022 Williams ..... F16M 11/041

OTHER PUBLICATIONS

Vinyl Record Stand Wall Mount—Etsy https://www.etsy.com/listing/1230695647/? (last accessed Oct. 16, 2022).
Vinyl Record Wall Mount—My Life Unit https://www.mylifeunit.com/Vinyl-Record-Wall-Mount-Rose-Gold?currency=USD (last accessed Nov. 6, 2023).
U-Shaped Clamp Mount with Phone Holder—Amazon https://www.amazon.com/Jomihoney-U-Shaped-Computer-Lighting-Distance/dp/B098XR7R2T (last accessed Nov. 6, 2023).

* cited by examiner

RECORD HOLDER

CROSS-REFERENCE TO RELATED APPLICATIONS

This application claims the benefit of U.S. Provisional Application No. 63/386,989, filed on Dec. 12, 2022, which is incorporated herein by reference in its entirety.

FIELD

The present disclosure relates to a holder. The holder may be beneficial in displaying records, record covers, or other art on a wall. The holder may be advantageous by easily allowing for content to be located therein by spacing an upper member from a lower member while remaining mounted to a supporting surface, such as a wall.

BACKGROUND

Record holders are quite common in retail and residential settings. These record holders allow for individuals to store records for later use and place record covers on display. Some holders focus on storing as many records or record covers as possible while others focus on predominantly displaying a single record or record cover.

Record holders exist today which allow for a record to be fitted in between two retaining channels. These channels are sometimes statically affixed relative to one another. This can cause issues with varying sizes and tolerances in record cover designs. Some holders can be adjusted to accommodate different heights but require removal of the holder from a wall to make the adjustment. Additionally, it can be cumbersome to insert and remove records or record covers from these holders. The records must be slid in from the side into the retaining channels (e.g., record cover remains parallel to the wall and slid in via the side into both channels at once). If a user has multiple holders on display on a single wall, adjacent holders block or at least complicate the insertion of a record into a record holder.

Thus, what is needed is a record holder which can be easily adjusted to allow for insert of a record or record cover from a front side. What is needed is a record holder which can accommodate varying sizes and tolerances of records or covers. What is needed is a record holder which can aesthetically display a record or records. What is needed is a record holder which can cooperate with other record holders to display a collection of records or record covers.

SUMMARY

The present disclosure relates to a holder for displaying content, the holder comprising: a) an upper member having an upper channel along at least a portion of a top peripheral edge; b) a lower member having a lower channel along at least a portion of a bottom peripheral edge; wherein the lower channel is located opposite from the upper channel; wherein a distance from the lower channel to the lower channel forms a holding gap configured to receive the content for display; and wherein the upper member is moveable relative to the lower member or vice-versa such that the upper channel moves further away from the lower channel or vice-versa and the holding gap is increased in size. The present disclosure relates to a holder for displaying content, the holder comprising: a) an upper member having: i) an upper channel along at least a portion of a top peripheral edge, wherein the upper channel is a substantially c-shaped channel; ii) one or more upper guide channels formed in a rear of the upper member; b) a lower member having: i) a lower channel along at least a portion of a bottom peripheral edge, wherein the lower channel is substantially a c-shaped channel; ii) one or more lower guide channels formed in a rear of the lower member and concentrically aligned with the one or more upper guide channels of the upper member; iii) a main body between the lower guide channel and the upper guide channel; c) one or more guide members at least partially located within the one or more guide channels and which bias the upper member toward the lower member, the lower member toward the upper member, or both, wherein the one or more guide members include: i) one or more guides located within the one or more guide channels; ii) one or more guide stops which retain the one or more guides statically affixed within the one or more upper guide channels and/or the one or more lower guide channels; iii) one or more biasing devices within the one or more lower guide channels and/or the one or more upper guide channels which provide a biasing force such as to bias the upper member toward the lower member, the lower member toward the upper member, or both; wherein the lower channel is located opposite from the upper channel; wherein a distance from the lower channel to the lower channel forms a holding gap configured to receive the content for display; wherein the upper member is moveable relative to the lower member and/or vice-versa such that the upper channel moves further away from the lower channel and/or vice-versa and the holding gap is increased in size; and wherein the main body has a circular planar shape which has a width greater than a width of the upper channel and the lower channel.

The present teachings provide for a holder which can be a record holder. The holder can be easily adjusted to accommodate a record or record cover by moving an upper member away from a lower member, lower member away from an upper member, or both. By allowing movement of the upper and/or lower member relative to the other, a record or record cover can be placed into the holder from the front of the holder as opposed to the size. Due to the ability to change the distance between the upper and lower members, the record holder can accommodate varying sizes and tolerances of records or covers. The holder by allowing insertion from a front, allows for a number of holders to be mounted adjacent and in close proximity to one another and records or record covers to be inserted therein within interfering with one another (e.g., not being able to access the side of one record holder by an adjacent holder obstructing access). The holder, by having smaller channels and the upper and lower sides provides for a large viewing space and minimal interference with the front of a record or record cover, providing for an aesthetic display.

DETAILED DESCRIPTION

Figure 1:
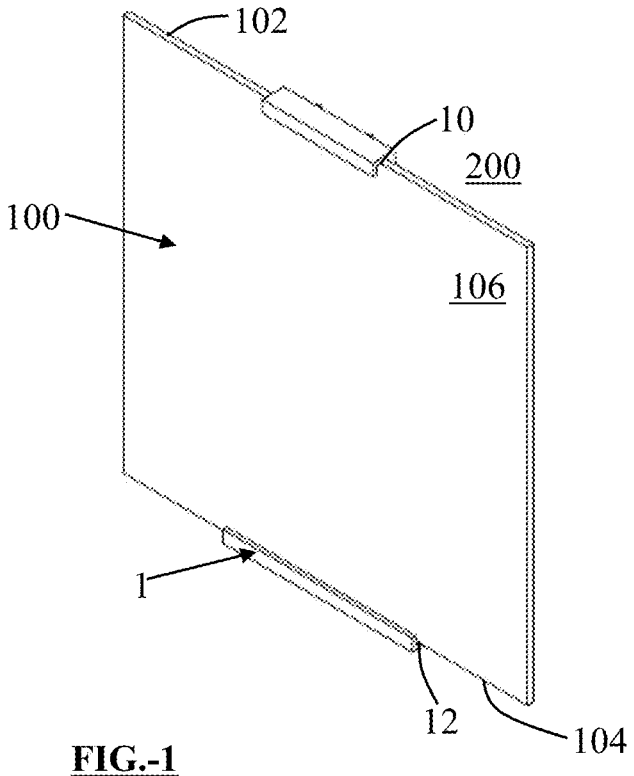
FIG. 1 a perspective view of a record cover retained within a record holder.

The explanations and illustrations presented herein are intended to acquaint others skilled in the art with the present teachings, its principles, and its practical application. The specific embodiments of the present teachings as set forth are not intended as being exhaustive or limiting of the present teachings. The scope of the present teachings should be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present disclosure relates to a holder. The holder may function to hold and display one or more records, record covers, other musical covers, artwork (e.g., painting, photograph), the like, or any combination thereof. The term "record" may be used hereinafter to refer to specifically a record or a record, record holder, musical cover, artwork, or the like. The holder may be referred to as a record holder. The record holder may be moveable from a closed position to an open position, from an open position to a closed position, or both. The record holder may be moveable between the closed position and the open position while remaining affixed to a wall. The record holder may be advantageous in allowing a user to place and/or remove a record, record cover, or the like while being affixed to a wall. The record holder may include an upper member, lower member, upper channel, lower channel, guide member, biasing devices, mounting features, the like, or any combination thereof.

The holder includes a lower member. The lower member functions as a holding support for the record, record cover, or the like. The lower member may function to statically affix the record holder to a supporting surface (e.g., wall). The lower member may have any suitable shape. The lower member may have a cross-section and/or planar shape which is at least partially trapezoidal, circular, semi-circular, triangular, square, pentagonal, rectangular, parallelogram, rhombus, ovular, the like, or any combination thereof. The shape may refer to the lower member as a whole, a main body area of the lower member, a channel of the lower member, or any combination thereof. For example, a main body of the lower member may have a circular shape, square shape, or any other while the channel area has a trapezoidal, rectangular, or other dissimilar shape. The lower member may have a cross-section shape which is reciprocal with, mates to, or continues the shape of an upper member. The lower member may include a main wall, a lower channel, one or more mounting features, one or more guide channels, or any combination thereof. The lower member may have a main wall. The main wall may be adjacent to, below, be integral with, form part of, or be the same as the main body. The main wall may have one or more mounting features. The main wall may have a lower channel projecting therefrom.

The holder includes a main body. The main body may function as the part of the holder which cooperates with a support surface to affix the holder to the support surface, such as via one or more mounting features. The main body may function to form a rear support for a record and/or record cover to rest upon. The main body may function to provide an aesthetically appealing surface of the holder when the holder is empty and void of a record and/or record cover therein. The main body may have a cross-section and/or planar shape which is at least partially trapezoidal, circular, semi-circular, triangular, square, pentagonal, rectangular, parallelogram, rhombus, ovular, the like, or any combination thereof. The main body may have a design substantially reciprocal and/or similar to the shape of a record and/or record cover.

The holder includes a lower channel. The lower channel may function to support and/or retain a portion of a record, record cover, or the like. The lower channel may retain a lower edge or bottom of a record. The lower channel may have a shape reciprocal with or otherwise suitable for retaining a record therein. The lower channel may have a shape reciprocal with a lower edge of a record, record holder, or the like. For example, the lower channel may have a substantially linear shape, such as to support a lower edge of a substantially square or rectangular record or other cover. For example, the lower channel may have a substantially arcuate shape, such as to support a lower edge of a record or other circular shaped artwork. The lower channel may have a three-dimensional shape which allows for easy insertion of a record from a front side of the record holder. The lower channel may be substantially c-shaped. The lower channel may be formed by the main wall, supporting wall, lip, or a combination thereof. The lower channel may include a supporting wall. The supporting wall may project outward from a lower edge of a main wall. The supporting wall may project orthogonally from the main wall. The lower channel may include a lip. A lip may project orthogonally from the supporting wall. A lip may project toward an upper member, upper channel, upward, opposite the direction of gravity, or any combination thereof.

The holder includes an upper member. The upper member functions as a holding support for the record, record cover, or the like. The upper member functions to cooperate with a guide member, one or more biasing devices, a lower member, or a combination thereof to adjust a holding gap. The upper member may be configured to move away and toward the lower member such as to increase and decrease the size of the holding gap. It is also contemplated that the upper member may remain static while the lower member may move, or both members may be moveable. The upper member may have any suitable shape. The upper member may have a cross-section shape which is at least partially trapezoidal, circular, semi-circular, triangular, square, pentagonal, rectangular, parallelogram, rhombus, ovular, the like, or any combination thereof. The upper member may have a cross-section shape which is reciprocal with, mates to, or continues the shape of a lower member. The upper member may include a main wall, an upper channel, one or more guide channels, or any combination thereof. The upper member may have a main wall. The main wall may have an upper channel projecting therefrom.

The holder includes an upper channel. The upper channel may function to support and/or retain a portion of a record, record cover, or the like. The upper channel may retain an upper edge or top of a record. The upper channel may prevent a record from tipping or falling out of the record holder. The upper channel may have a shape reciprocal with or otherwise suitable for retaining a record therein. The upper channel may have a shape reciprocal with an upper edge of a record, record holder, or the like. For example, the upper channel may have a substantially linear shape, such as to support an upper edge of a substantially square or rectangular record or other cover. For example, the upper channel may have a substantially arcuate shape, such as to support an upper edge of a record or other circular shaped artwork. The upper channel may have a three-dimensional shape which allows for easy insertion of a record from a front side of the record holder. The upper channel may be substantially c-shaped. The upper channel may be formed by the main wall, supporting wall, lip, or a combination thereof. The upper channel may include a supporting wall. The supporting wall may project outward from an upper edge of a main wall. The supporting wall may project orthogonally from the main wall. The supporting wall may project substantially parallel to a supporting wall of a lower channel. The upper channel may include a lip. A lip may project orthogonally from the supporting wall. A lip may project toward a lower member, lower channel, downward, in a same direction of gravity, or any combination thereof. A lip of the upper channel may project in a direction parallel to a lip of a lower channel.

The holder includes a holding gap. The holding gap may function to retain a substantially portion of a record, record cover, or the like. The holding gap may function to adapt in size to allow for easy insertion of a record, record cover, or the like. The holding gap may be formed as a distance between an upper channel and lower channel. The holding gap may be formed as the distance between the supporting wall of an upper channel and the supporting wall of a lower channel. The holding gap is configured to decrease and increase in size. The holding gap may increase in size by moving the upper member, upper channel, or both away from the lower member, lower channel, or both. The holding gap may decrease in size by moving the upper member, upper channel, or both toward the lower member, lower channel, or both. The upper member may be moved relative to the lower member by pulling, sliding along one or more guides, being biased by one or more biasing devices, the like, or any combination thereof.

The holding gap may have a distance and/or height. The height may be measured as the interior distance between the opposing supporting walls of the upper and lower channels. The height may be sufficiently to retain a record cover and/or record therein without damaging either. A typical record cover for a 12 inch record is approximately 12.5 inches wide by 12.5 inches tall. Thus, the height may be 12.5 inches or greater when the holder is in a closed position. The height may be about 12.5 inches or greater, about 12.75 inches or greater, about 13 inches or greater. The height may be about 15 inches or less, about 14.5 inches or less, about 14 inches or less, about 13.75 inches or less, or even about 13.5 inches or less. The height (otherwise known as the upper and lower channels) may or may not apply some compression about the upper and lower edges of a record holder. If a height of the holding gap is greater than a height of a record, the upper and/or lower lips of the upper and lower channels may aid in retaining the record holder and/or record within the holding gap, prevent falling forward and out of the holder, or both. This is a key difference is compared to most compression style holders, such as that of commonly referred to selfie stick for smart phones, as this compression fit which holds the phone into the selfie stick would result in damage to a record cover. The holding gap may be able to be increased in size by moving into the open position. The holding gap may be increased in size by about 0.25 inches or greater, 0.5 inches or greater, 0.75 inches or greater, or even 1 inch or greater when expanding the holder from the closed position to the open position. The holding gap may be increased in size by about 2 inches or less, about 1.5 inches or less, or even about 1.25 inches or less when expanding the holder form the closed position to the open position.

The holder also includes a lip gap. The lip gap may be the distance between the top edge of the lip of the lower channel and the bottom edge of the lip of the upper channel. In the closed position, the lip gap may be smaller than the height of a record holder, record, and/or the like. In the open position, the lip gap may be smaller, equal to, or even greater than a height of a record holder, record, and/or the like. But by expanding into the open position, the record holder and/or record is able to be inserted from a front of the holder into the holding gap. The lip gap may be about 0.1 inches or greater, about 0.25 inches or greater, about 0.5 inches or greater, or even about 0.75 inches or greater smaller than the height holding gap. The lip gap may be about 2 inches or less, about 1.5 inches or less, or even about 1 inch or less smaller than the height of the holding gap. In other words, each lip may have a height of about 0.1 inches or greater, 0.2 inches or greater, 0.3 inches or greater, or even about 0.35 inches or greater. Each lip may have a height of about 1 inch or less, about 0.8 inches or less, about 0.6 inches or less, or even about 0.5 inches or less.

The holder may include one or more mounting features. The mounting features may function to retain the holder to a supporting surface, retain one or more portions of the holder static while one or more other portions move, offset a wall of the holder to allow for clearance from a supporting surface, the like, or any combination. The one or more mounting features may be part of an upper member, lower member, or both. The one or more mounting features may be part of a member which remains static as opposed to being moveable. For example, the one or more mounting features may be part of a lower member. By being part of a lower member, the lower member may be statically affixed to a supporting surface while allowing for an upper member to be moveable relative to the lower member. The one or more mounting features may include one or more bosses, openings, fasteners, mounting pads, adhesives, or the like. For example, the rear of a main body may include one or more mounting pads integrally formed thereon. The mounting pads may function to receive (e.g., have affixed thereon) one or more adhesive strips. For example, Command™ strips may be adhered to the mounting pads to provide a temporary means of affixing the holder to a supporting surface. One or more bosses may be part of a lower member, upper member, or both. The one or more bosses may outwardly project from a main wall of a lower member. The one or more bosses may project toward the supporting surface. The one or more bosses and/or mounting pads may have a height such as to offset the main wall of the upper member, lower member, or both from the supporting surface. Height may be measured as a distance from a rear surface of a main body toward the opposing surface of the boss and/or mounting pad. One or more openings may pass through a wall of the upper member, lower member, or both. The one or more openings may function to allow one or more fasteners to pass therethrough. The one or more openings may pass through the one or more bosses. One or more fasteners may include any fastener suitable for mounting the holder to a support surface. One or more fasteners may include one or more threaded fasteners, non-threaded fasteners, or both. For example, one or more bolts and/or screws may pass through the one or more openings and into the support surface.

The holder may include one or more guide channels. One or more guide channels may function to translate along one or more guides, allow for movement of one member (e.g., upper) relative to another member (e.g., lower), house one or more guide members, the like, or any combination thereof. One or more guide channels may have any size and/or shape which may allow for one or more guide members to at least partially reside therein, one or more biasing devices to reside therein, movement along one or more guides, or any combination thereof. One or more guide channels may be located at a rear, side, or even front of one or more members (e.g., upper, lower). One or more guide channels may be located along a rear of an upper member, lower member, or both. One or more guide channels may be affixed and/or integral (e.g., molded of the same material) with one or more members. One or more guide channels may have a shape which substantially reciprocal to the shape of one or more guides. One or more guide channels may have a shape which is substantially cylindrical, rectangular prismed, triangular prismed, the like, or any combination thereof. The one or more guide channels may be hollow. The one or more guide channels may have a hollow pass through extending along a portion or all of their length. The hollow pass through may house a guide. The one or more guide channels may include a single guide channel or a plurality of guide channels. A plurality of guide channels may include two or more guide channels. For example, two guide channels may be symmetrically placed at a rear of the upper and lower members. The one or more guide channels may be divided into one or more upper guide channels and one or more lower guide channels. The upper guide channels may be part of an upper member. The lower guide channels may be part of a lower member. The upper guide channels may be aligned with (e.g., concentric, axially centered) with the lower guide channels. Alignment may allow for a guide member to easily extended through both.

The holder may include one or more guide members. A guide member may function to allow for movement of one member relative to another member, limit movement to axial translation, or both. A guide member may be at least partially located within one or more guide channels. A guide member may be located in one or more upper guide channels and lower guide channels. A guide member may be configured to remain statically affixed to one or more upper guide channels or lower guide channels while allowing for translation of one or more lower guide channels or upper guide channels relative thereto. The one or more guide members may include one or more guides, guide stops, retainers, the like, or any combination thereof. One or more guides may reside within one or more guide channels. One or more guides may have a shape substantially reciprocal with a hollow interior of a guide channel. The one or more guides may be substantially rod-shaped. The same number of guides may be present as guide channels. For example, there may be two guides. The one or more guides may include one or more guide stops. One or more guide stops may be formed as one or more heads of the one or more guide stops. The head may have a width larger than the guide and an opening of a guide channel. The head may abut with an exterior of the guide channel to affix the guide therein. A plurality of guides may be joined via a guide stop. A guide stop may extend from one guide to an opposing guide. The guides may project substantially orthogonally from the opposing ends of the guide stop. A guide stop may distance the guides. The guide stop may have a shape similar to the shape of the guides. The guides and guide stop may be formed as a single unitary component. A guide stop may also function to restrict movement of the guide member relative to the guide channels. The ends of the one or more guides may be engaged with one or more retainers. One or more retainers may function to retain one or more biasing devices affixed to the guide member. One or more retainers may be engaged via one or more threads, a friction fit, or the like to the one or more guides. For example, the ends of each guide may include a threaded portion. The threaded portion may mate with a retainer which includes a threaded interior.

The holder may include one or more biasing devices. One or more biasing devices may function to bias one or more members toward one or more other members. One or more biasing devices may bias an upper member toward a lower member, lower member toward an upper member, or both. One or more biasing devices may bias the holder into a closed position from an open position. The one or more biasing devices may include any biasing device capable of biasing one member toward the other member. One or more biasing devices may reside within and/or about one or more guide channels, about one or more guides, or both. One or more biasing devices may be retained in place via one or more retainers. One or more biasing devices may include one or more springs, elastomeric materials, or both. One or more springs may include one or more compression springs, extension springs, torsion springs, and/or the like. For example, one or more compression springs may be located about one or more guides and located within the one or more guide channels. One or more elastomeric materials may include rubber, silicone, and/or thermoplastic elastomers. For example, one or more elastomeric materials may include a rubber sleeve. The rubber sleeve may be located about the one or more guides and within the one or more guide channels.

The present teachings relate to a method of inserting a record cover and/or record into a holder. The holder may be the holder according to the disclosure. The method may include mounting a holder to a support surface. Mounting may utilize one or more mounting features as disclosed herein. Mounting may include affixing a main body or other portion of a lower member, or even the upper member, to a support surface via one or more mounting features. The method may include expanding the holder into an open position from a closed position. Expanding may include pulling (e.g., user grasping and pulling) an upper member away from a lower member, a lower member away from an upper member, or both. The pulling may provide a force greater than the biasing force of one or more biasing devices such as to overcome the biasing force. The method may include placing a record, record cover, and/or the like into the holder. Placing may include inserting from the front of the holder. The method may include placing a record, record cover, and/or the like into a holding gap of the holder, onto a lower channel, onto a supporting wall of a lower channel, or a combination thereof. The method may include closing the holder back into the closed position. Closing the holder may include removing the pull force from the upper member, the lower member, or both such that the biasing force is once again applied and biases one member toward the other.

Illustrative Examples

FIG. 1 illustrates a record cover 100. The record cover 100 is retained by a record holder 1. The record holder 1 includes an upper channel 10 and a lower channel 12. An upper edge 102 of the record cover 100 is located within the upper channel 10. A lower edge 104 of the record cover 100 is located within the lower channel 12. An exterior face 106 of the record cover 100 remains exposed and viewable. The record holder 1 is mounted to a wall 200.

Figure 4:
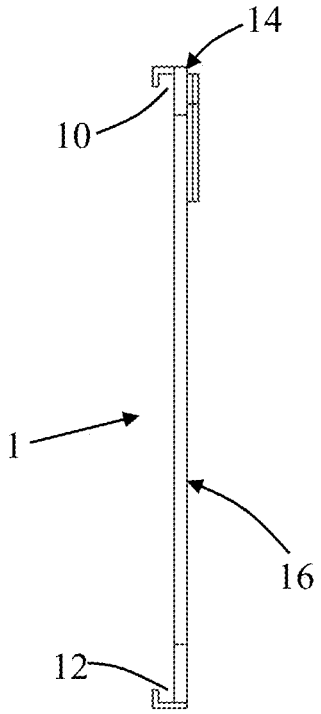
FIG. 4 is a side view of a record holder in a closed position.
Figure 2:
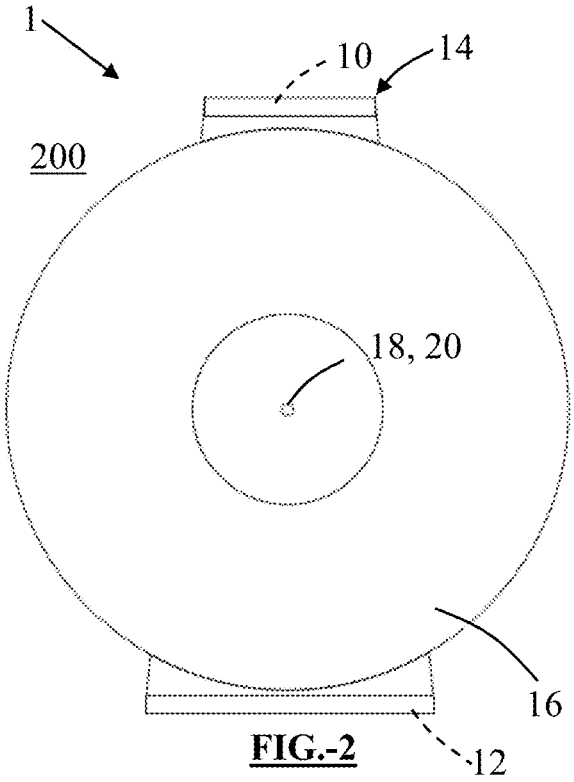
FIG. 2 is a front view of a record holder in a closed position.
Figure 3:
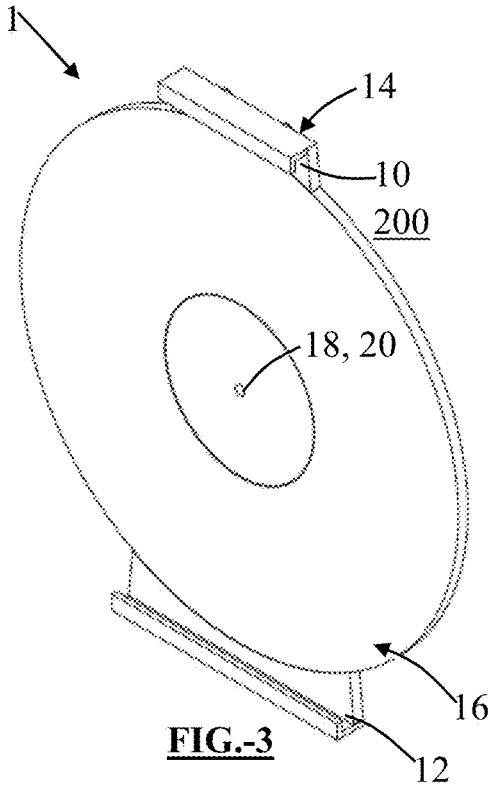
FIG. 3 is a front perspective view of a record holder in a closed position.

FIGS. 2-4 illustrate a record holder 1. The record holder 1 includes an upper member 14 adjacent to a lower member 16. The upper member 14 includes an upper channel 10. The upper channel 10 is formed along the upper peripheral edge of the upper member 14. The upper channel 10 is formed similar to a C-channel. The lower member 16 includes a lower channel 12. The lower channel 12 is formed along the lower peripheral edge of the lower member 16. The lower channel 12 is formed similar to a C-channel. The record holder 1 includes a mounting hole 20. Through the mounting holes 20 are fasteners 18. The fasteners 18 affix the record holder 1 to a wall 200 or other surface. The mounting holes 20 are located in the lower member 16. This allows for the lower member 16 to remain static while the upper member 14 may be moveable relative to the lower member 16 and/or wall 200.

Figure 5:
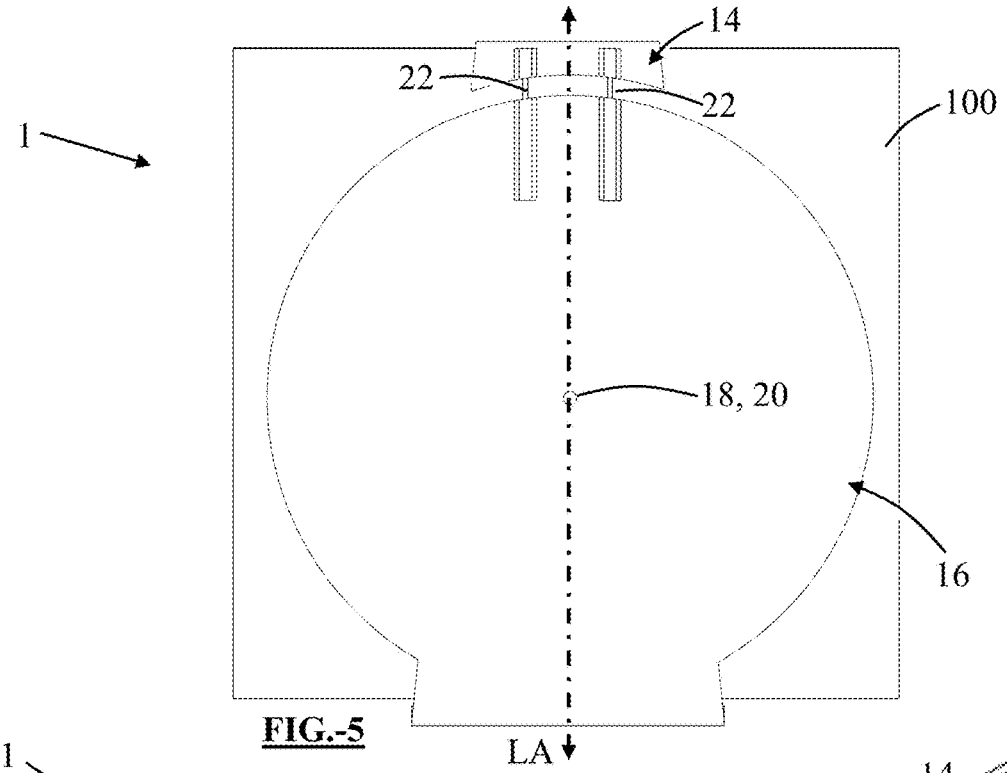
FIG. 5 is a rear view of a record holder in an open position with a record cover being located or removed.
Figure 6:
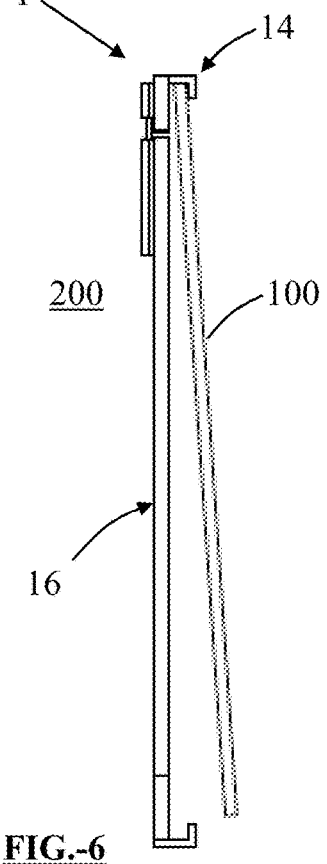
FIG. 6 is a side view of a record holder in an open position with a record cover being located or removed.
Figure 7:
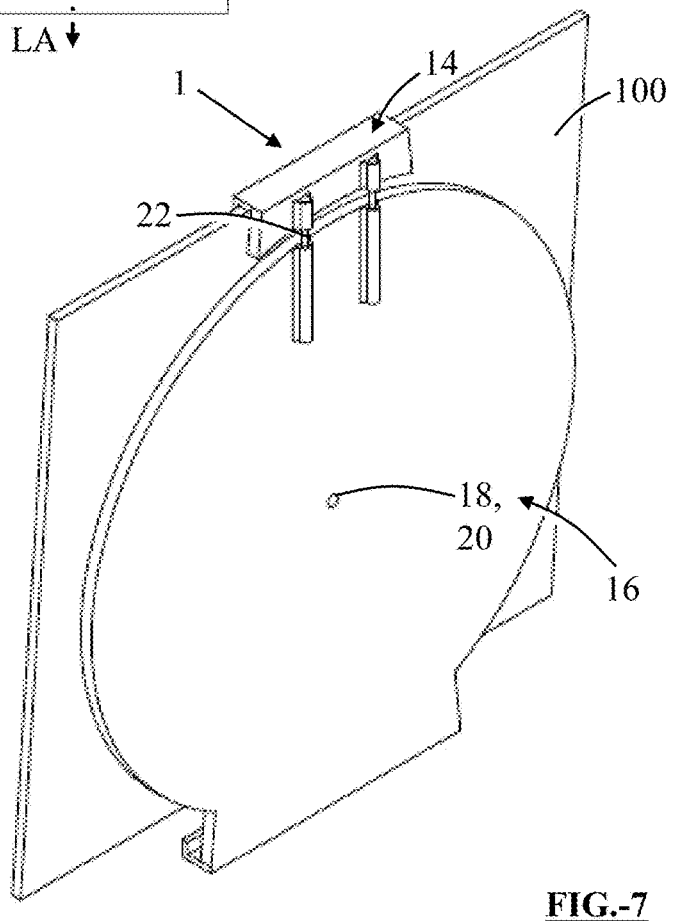
FIG. 7 is a rear perspective view of a record holder in an open position with a record cover being located or removed.

FIGS. 5-7 illustrate a close-up view of a record holder 1. The record holder 1 includes an upper member 14 and a lower member 16. The lower member 16 is statically affixed to a wall 200. The lower member 16 is affixed via fastener 18. The fastener 18 passes through a mounting hole 20. The upper member 14 is moveable relative to the lower member 16. The upper member 14 is movable away from the lower member 16. The upper member 14 is able to be translated axially along one or more guides 22. The upper member 14 is translated along (e.g., parallel, in line with) a longitudinal axis LA of the record holder 1. By the upper member 14 moving away from the lower member 16, or vice-versa, a record cover 100 is able to be inserted or removed from the record holder 1.

Figure 8:
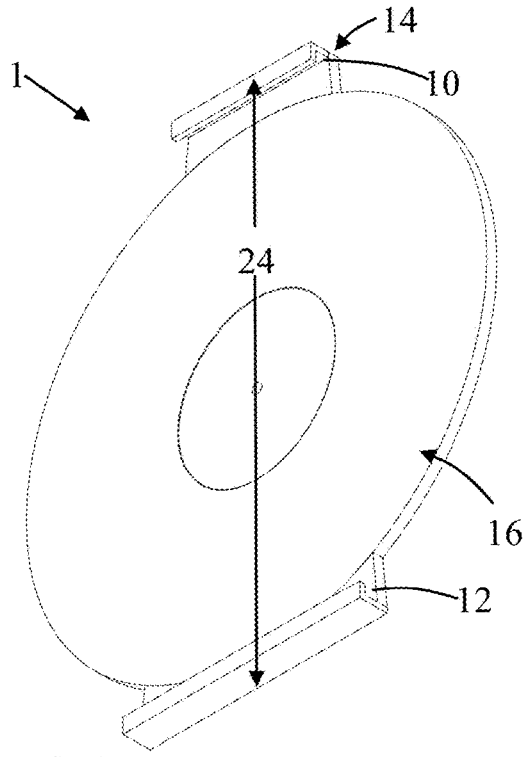
FIG. 8 is a front perspective view of a record holder.

FIG. 8 illustrates a record holder 1. The record holder 1 includes an upper member 14 with an upper channel 10. The record holder 1 includes a lower member 16 having a lower channel 12. A holding gap 24 is formed between the upper channel 10 and the lower channel 12. The holding gap 24 is configured to increase in distance when the upper member 14 is moved away from the lower member 16.

Figure 9:
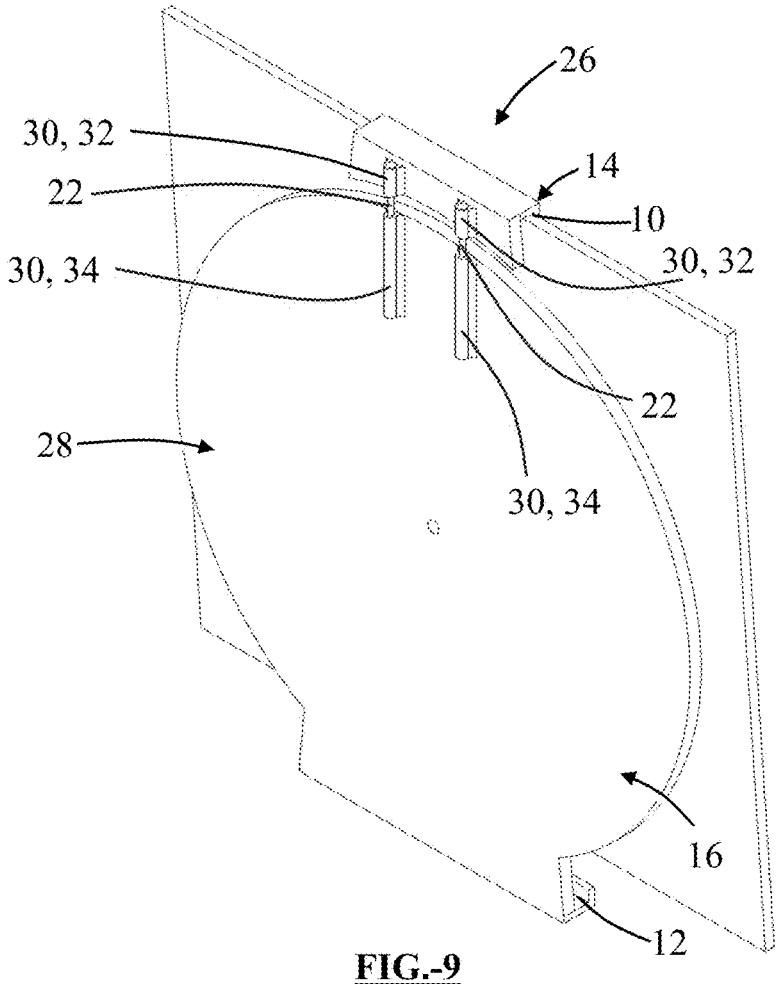
FIG. 9 is a rear perspective view of a record holder.

FIG. 9 illustrates a record holder 1. The record holder 1 includes an upper member 14 with an upper channel 10. The upper channel 10 extends outward toward a front 26 of the record holder 1. The record holder 1 includes a lower member 16 with a lower channel 12. The lower channel 12 extends outward toward a front 26 of the record holder 1. The record holder 1 includes guide channels 30. The guide channels 30 are formed at the rear 28 of the record holder 1. The guide channels 30 include upper guide channels 32 and lower guide channels 34. The guide channels 30 each house a guide 22 therein. The guides 22 are configured to remain static within the upper guide channels 32. Specifically, a guide stop 38 (not shown) retains each guide 22 statically affixed within each upper guide channel 32. The guides 22 are configured to translate along and within the lower guide channels 34. Retainers 44 (not shown) in combination with the opening size of the lower guide channels 34 prevents the guides 22 from being pulled out of the lower guide channels 34.

Figure 10:
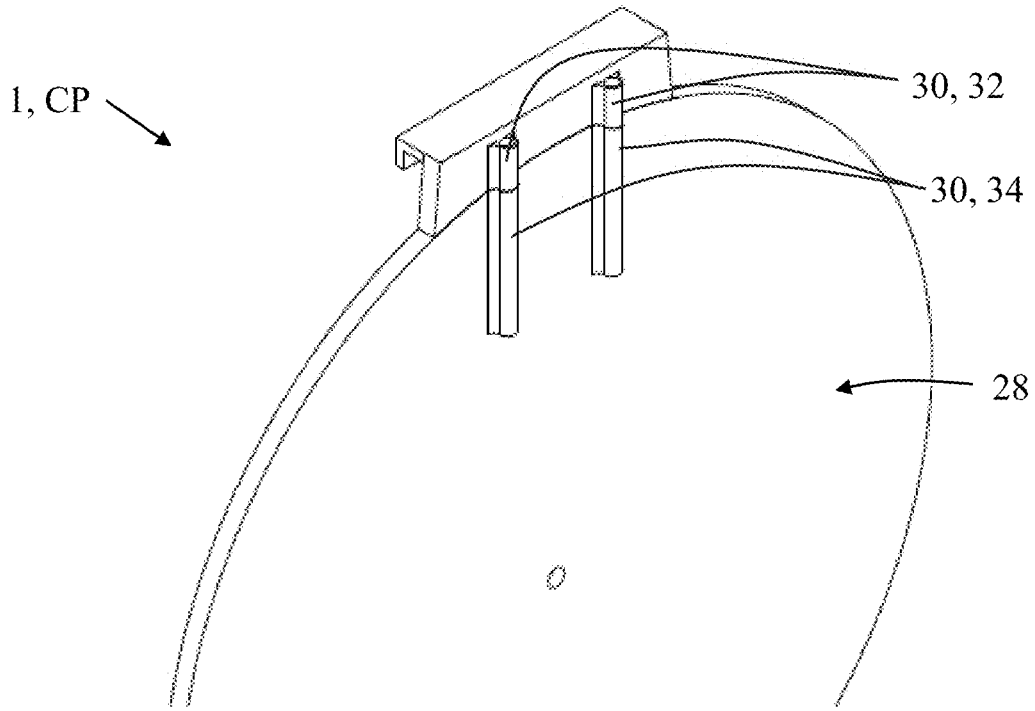
FIG. 10 is a rear perspective view of a record holder in a closed position.
Figure 11:
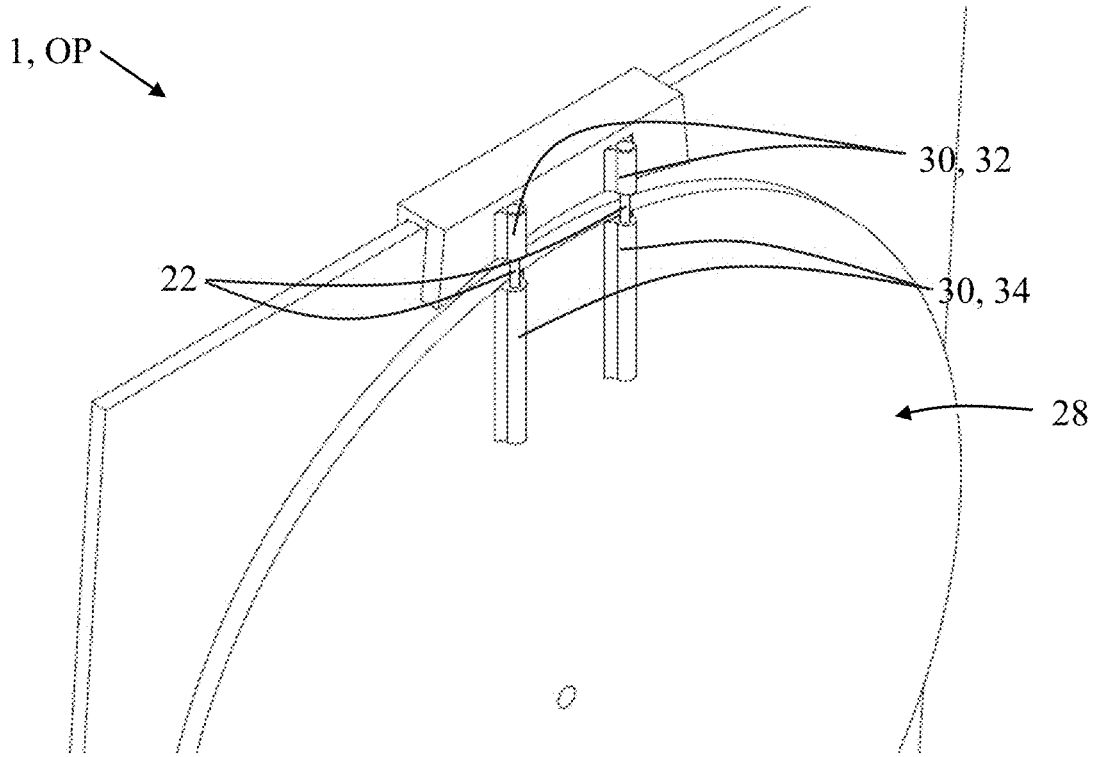
FIG. 11 is a rear perspective view of a record holder in an open position.

FIGS. 10 and 11 illustrate a close-up view of a rear 28 of the record holder 1 from a closed position CP (FIG. 10) to an open position OP (FIG. 11). The record holder 1 includes guide channels 30, including upper guide channels 32 and lower guide channels 34. The upper guide channels 32 are aligned (e.g., concentric) with the lower guide channels 34 such as to form a continuous channel for the guides 22 (not shown in FIG. 10) to extend therethrough.

Figure 12:
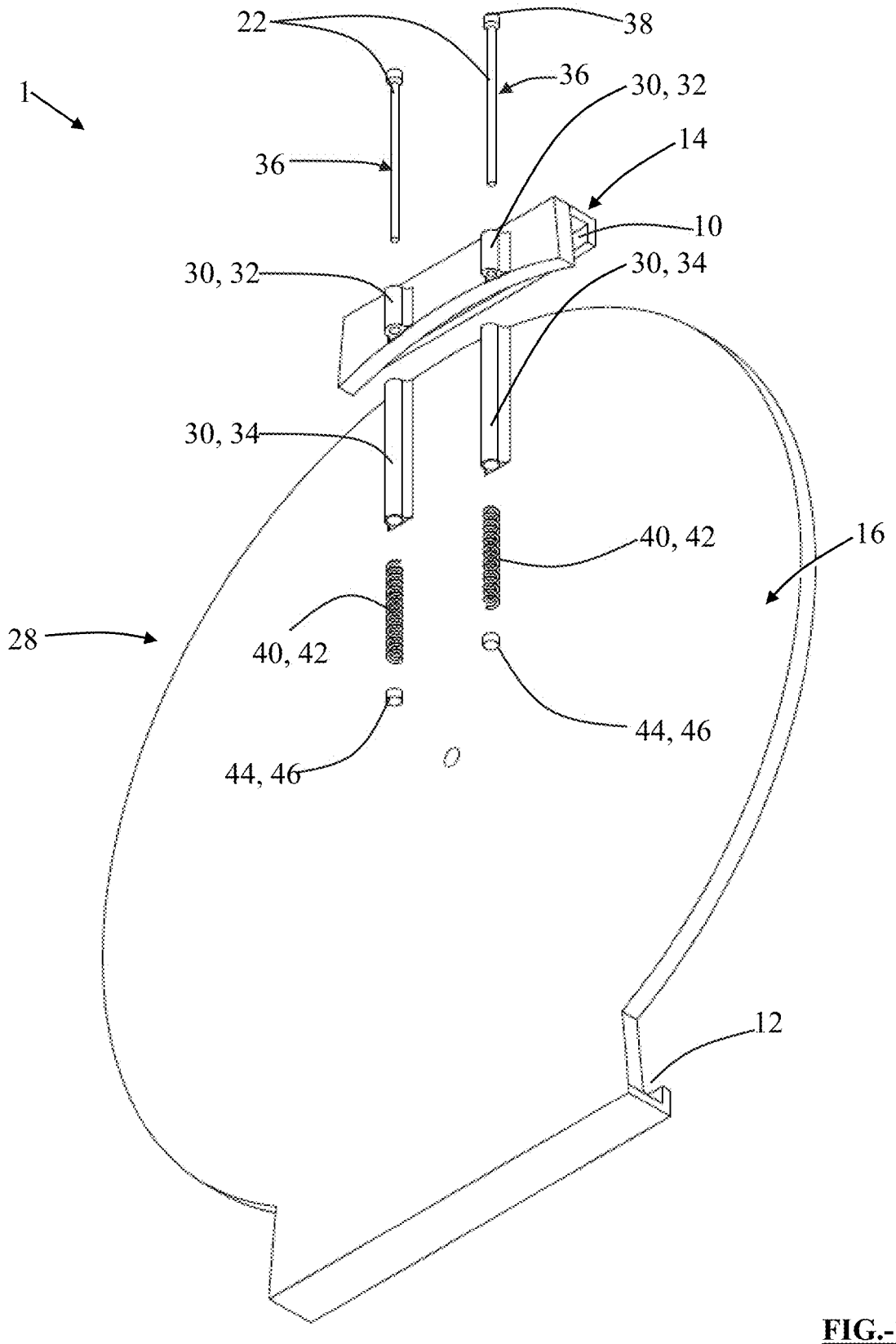
FIG. 12 is a rear exploded perspective view of a record holder.

FIG. 12 is a rear exploded perspective view of a record holder 1. The record holder 1 includes an upper member 14 and a lower member 16. The record holder 1 includes guide channels 30, including upper guide channels 32 and lower guide channels 34. The guide channels 30 house a guide member 36. The guide member 36 includes guides 22. The guide member 36 includes a guide stop 38. The guide stops 38 are formed as heads on the guides 22. The record holder 1 includes biasing devices 40. The biasing devices are configured as compression springs 42. The record holder 1 includes retainers 44. The retainers 44 are configures as nuts 46.

Figure 13:
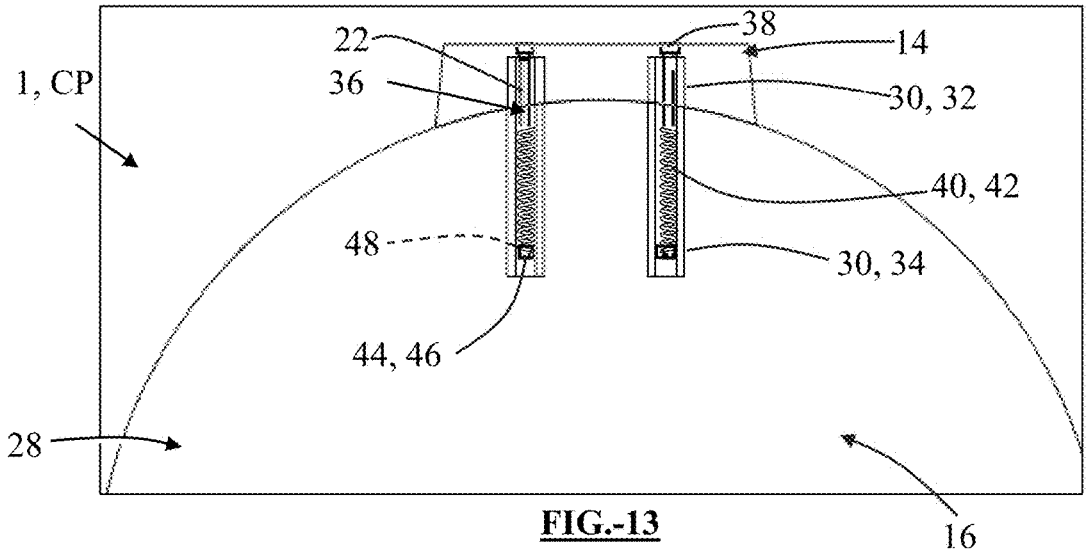
FIG. 13 is a partially transparent rear view of a portion of a record holder.

FIG. 13 illustrates a close-up and partially transparent view of a rear 28 of a record holder 1. The record holder 1 is in a closed position OP. The record holder 1 includes guide channels 30. The guide channels 30 include an upper guide channel 32 and a lower guide channel 34. Located within the guide channels 30 is a guide member 36. The guide member 36 is statically affixed to the upper member 14. The guide member 36 includes guides 22 which extend through the guide channels 30. The guide member 36 is statically affixed relative to the upper member 14 via a guide stop 38. The guide stop 38 prevents movement of the guide member 36. The guides 22 are configured to translate along the guide channels 30, specifically the lower guide channels 34 such that the upper member 14 moves axially away from the lower member 16. The upper member 14 is biased toward the lower member 16 via biasing devices 40. The biasing devices 40 are compression springs 42. The biasing devices 40 reside within the lower channels 34. The biasing devices 40 include the guides 22 extending therethrough. The biasing devices 40 are retained within the lower channels 34 and about the guides 22 via retainers 44. The retainers 44 are formed as nuts 46. The guides 22 include engagement features 48. The engagement features 48 can be threaded ends or other mating fittings at the ends of the guides 22. The engagement features 48 mate and/or engage with the retainers 44.

FIGS. 14-17 illustrate differing views and dimensions of the record holder 1.

Figure 14:
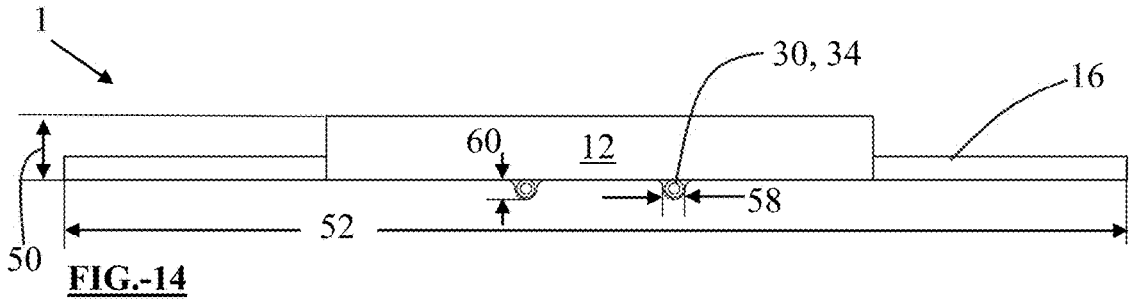
FIG. 14 is a bottom plan view of a record holder.

FIG. 14 illustrates a bottom view of the record holder 1. The lower member 16 is illustrated. The lower member 16 includes the lower channel 12. The lower member 16 includes a depth 50 and a width 52. The lower member 16 also includes lower guide channels 34. The lower guide channels 34 each have a width 58. The lower guide channels 34 also each have a depth 60. The depth 60 is measured as the distance from a rear edge of the lower channel 12 to the free end of the lower guide channel 34.

Figure 15:
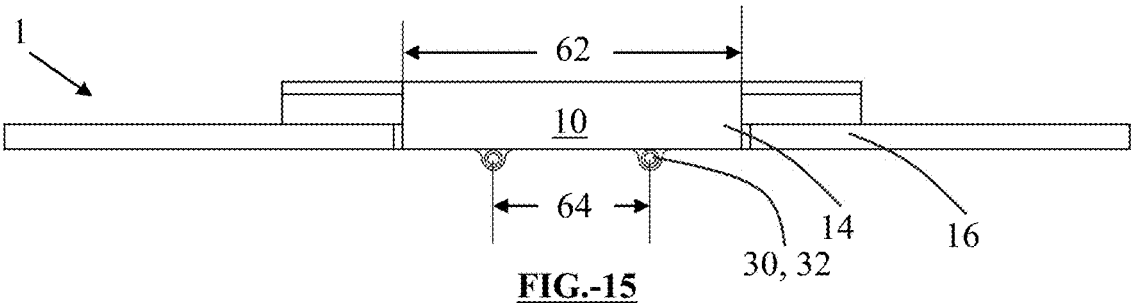
FIG. 15 is a top plan view of a record holder.

FIG. 15 illustrates a top view of the record holder 1. The record holder 1 includes an upper member 14. The upper member 14 includes an upper channel 10. The upper channel 10 has a width 62. The upper guide channels 32 are spaced apart by distance 64. The distance 64 is measured as the distance between the central axes of each guide channel 30, 32.

Figure 16:
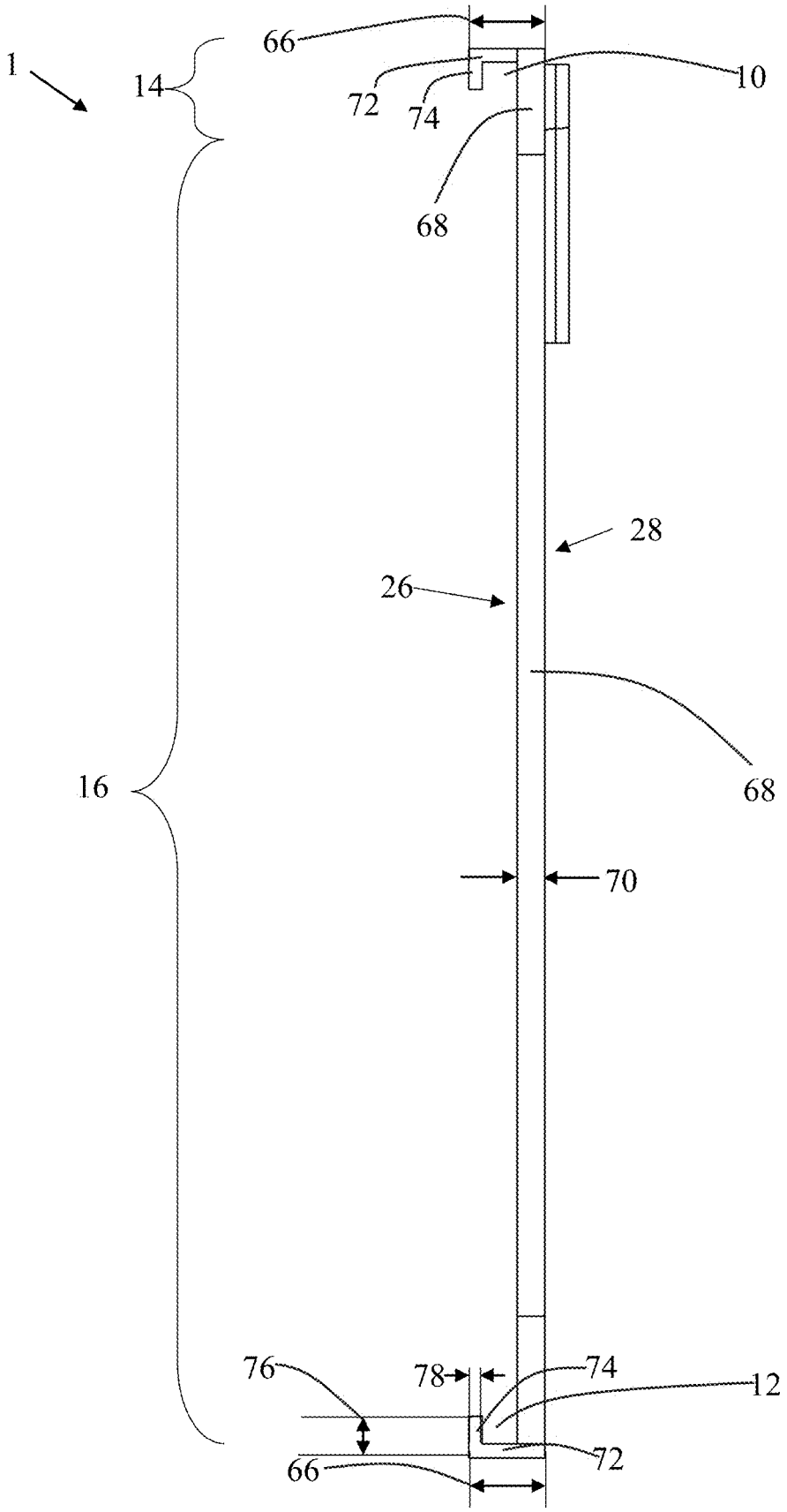
FIG. 16 is a side plan view of a record holder.

FIG. 16 illustrates a side view of the record holder 1. The record holder 1 includes an upper member 14 and a lower member 16. The record holder 1 includes an upper channel 10 opposite a lower channel 12. The upper channel 10 includes a thickness 66. The lower channel 12 includes the same thickness. The upper member 14 and the lower member 16 each include a main wall 68. The main wall 68 includes a wall thickness 70. The wall thickness 70 is the thickness or distance from a front 26 of the main wall 68 to a rear 28 of the main wall 68. Each channel 10, 12 includes a supporting wall 72 and a lip 74. The support wall 72 projects orthogonally from the main wall 68. The lip 74 projects orthogonally from the support wall 72. The lip 74 is parallel to the main wall 68. The lip 74 of the lower channel 12 projects upward toward the upper channel 10. The lip 74 of the upper channel 10 projects downward toward the lower channel 12. The lip 74 has a height 76 and a thickness 78.

Figure 17:
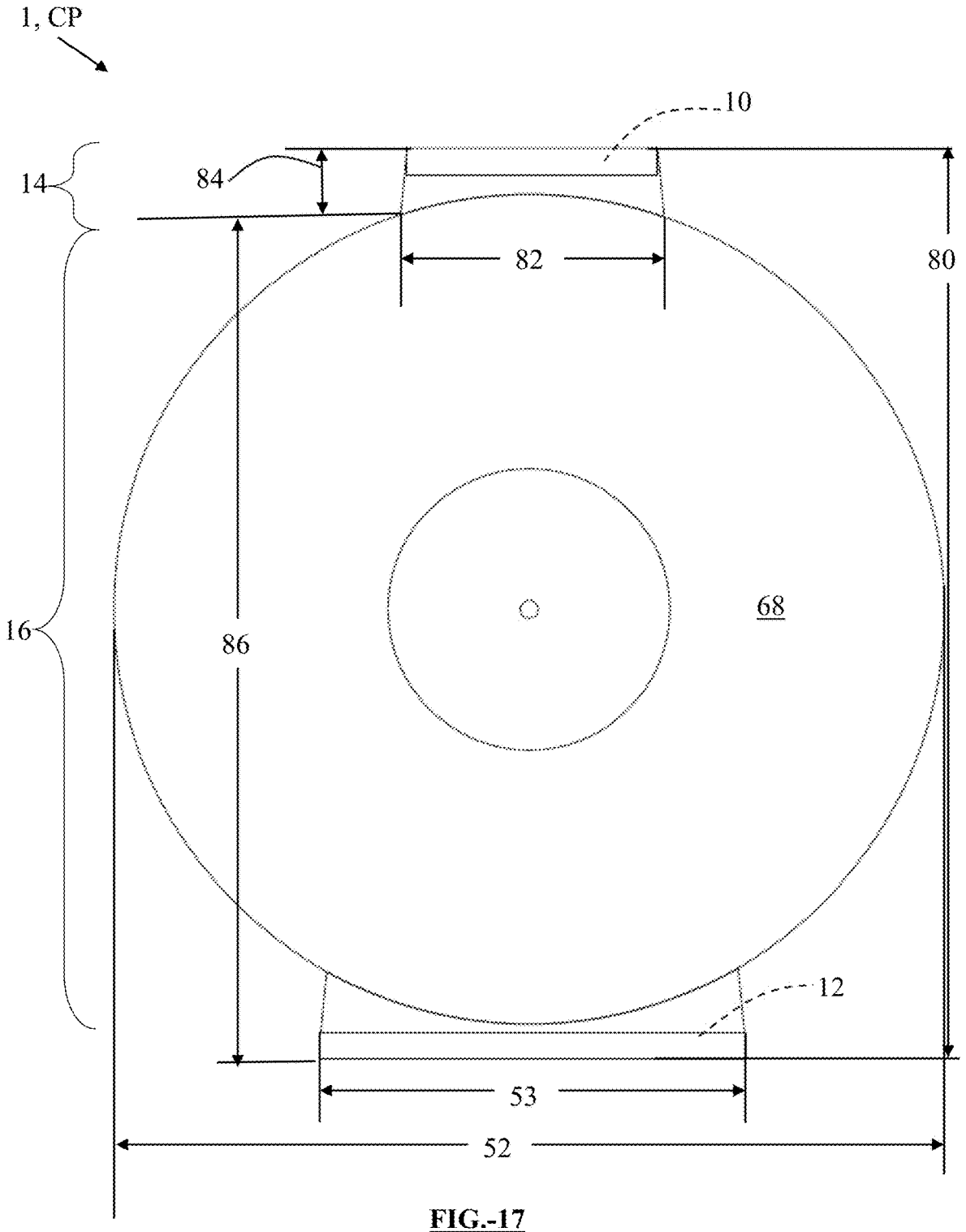
FIG. 17 is a front plan view of a record holder.

FIG. 17 is a front plan view of the record holder 1. The record holder 1 is in a closed position CP. The record holder 1 includes an upper member 14 with an upper channel 10. The record holder 1 includes a lower member 16 with a lower channel 12. The record holder 1 has an overall height 80. The upper member 14 is has a tapering width. The width is narrowest at the width of the upper channel 10 (as shown in FIG. 15) and widens to the overall width 82. The upper member 14 also has a height 84. The lower member 16 has both a width of the main body 52 and a tapered width 53 at the lower channel 12. The width of the lower channel 12 is narrowest adjacent to main wall 68 and widens to the width 53 of the lower channel 53. The width 52 of the record holder 1 is widest at the main body 68. The lower member 16 has a height 86.

FIGS. 10 to 13 of U.S. Provisional Application No. 63/386,989 provide for dimensions. It is contemplated that these dimensions may be approximations. It is also contemplated that such dimensions may be incorporated into the illustrative examples provided herein and are incorporated by reference in their entirety. It is contemplated that these dimensions may be adapted for the particular use of the holder. It is contemplated that each dimension, while provided as a single number, is intended to cover a range. The range may be up to plus or minus 50% from the illustrated dimension. For example, the width of 95.25 mm may cover a range of about 47.625 mm to 142.875 mm.

REFERENCE NUMBERS

1—Record Holder
10—Upper channel
12—Lower channel
14—Upper Member
16—Lower Member
18—Fastener
20—Mounting hole
22—Guides
24—Holding gap
26—Front of record holder
28—Rear of record holder
30—Guide channel
32—Upper guide channel
34—Lower guide channel
36—Guide member
38—Guide stop
40—Biasing device
42—Compression spring
44—Retainer
46—Nut
48—Engagement features
50—Depth
52—Width
53—Width at lower channel
58—Width of lower guide channel
60—Depth of lower guide channel
62—Width of upper channel
64—Distance between axes of upper guide channels
66—Thickness of upper channel
68—Main wall
70—Wall thickness
72—Supporting wall
74—Lip
76—Height of lip
78—Thickness of lip
80—Height of record holder
82—Overall width of upper member
100—Record Cover
102—Upper edge
104—Lower edge
106—Exterior face
200—Wall
LA—Longitudinal axis
OP—Open position
CO—Closed position Any numerical values recited in the above application include all values from the lower value to the upper value in increments of one unit provided that there is a separation of at least 2 units between any lower value and any higher value. These are only examples of what is specifically intended and all possible combinations of numerical values between the lowest value, and the highest value enumerated are to be considered to be expressly stated in this application in a similar manner. Unless otherwise stated, all ranges include both endpoints and all numbers between the endpoints.

The terms "generally" or "substantially" to describe angular measurements may mean about +/−10° or less, about +/−5° or less, or even about +/−1° or less. The terms "generally" or "substantially" to describe angular measurements may mean about +/−0.01° or greater, about +/−0.1° or greater, or even about +/−0.5° or greater. The terms "generally" or "substantially" to describe linear measurements, percentages, or ratios may mean about +/−10% or less, about +/−5% or less, or even about +/−1% or less. The terms "generally" or "substantially" to describe linear measurements, percentages, or ratios may mean about +/−0.01% or greater, about +/−0.1% or greater, or even about +/−0.5% or greater.

The term "consisting essentially of" to describe a combination shall include the elements, ingredients, components, or steps identified, and such other elements ingredients, components or steps that do not materially affect the basic and novel characteristics of the combination. The use of the terms "comprising" or "including" to describe combinations of elements, ingredients, components, or steps herein also contemplates embodiments that consist essentially of the elements, ingredients, components, or steps.

Plural elements, ingredients, components, or steps can be provided by a single integrated element, ingredient, component, or step. Alternatively, a single integrated element, ingredient, component, or step might be divided into separate plural elements, ingredients, components, or steps. The disclosure of "a" or "one" to describe an element, ingredient, component, or step is not intended to foreclose additional elements, ingredients, components, or steps.

What is claimed is:

1. A holder for displaying a content, the holder comprising:

a) an upper member having:

i) a first main wall integral with a first supporting wall which is integral with a first lip, wherein the first main wall has a front surface which is planar and opposite a rear surface which is planar, and wherein an upper exterior surface of the first supporting wall is the uppermost surface of the upper member;

ii) an upper channel in the form of a c-channel formed by the first main wall, the first supporting wall, and the first lip and formed along a top portion of the upper member, wherein the upper channel is straight and extends laterally across an entire width of the top portion of the upper member;

iii) one or more upper guide channels projecting from the rear surface of the first main wall and each of the one or more upper guide channels having a first hollow pass through;

b) a lower member having:

i) a second main wall integral with a second supporting wall which is integral with a second lip, wherein the second main wall has a front surface which is planar and opposite a rear surface which is planar, and wherein a lower exterior surface of the second supporting wall is the lowermost surface of the lower member;

ii) a lower channel in the form of a c-channel formed by the second main wall, the second supporting wall, and the second Hips lip and formed along a bottom portion of the lower member, wherein the lower channel is straight and extends laterally across an entire width of the bottom portion of the lower member;

iii) one or more lower guide channels projecting from the rear surface of the second main wall and each of the one or more lower guide channels having a second hollow pass through;

c) one or more guide members at least partially located within the one or more upper guide channels and at least partially located within the one or more lower guide channels, wherein each of the one or more guide members includes:

i) a guide located within a respective one of the one or more upper guide channels and located within a respective one of the one or more lower guide channels; and ii) a guide stop which retains the guide statically affixed within the respective one of the one or more upper guide channels;

d) one or more biasing devices which bias the upper member toward the lower member;

wherein the lower channel is located opposite from and parallel to the upper channel;

wherein a distance from the lower channel to the upper channel forms a holding gap which is configured to receive the content therein for display;

wherein the upper member is moveable relative to the lower member such that the upper channel moves further away from the lower channel and the holding gap is increased in size;

wherein the lower member includes one or more mounting features which include one or more mounting holes passing through the second main wall between the lower channel and an upper edge of the lower member so that the lower member is configured to be statically affixed to a supporting surface located behind the lower member, and wherein the supporting surface is a wall of a dwelling or other building; and wherein the one or more mounting features have one or more fasteners extending therethrough.

2. The holder of claim 1, wherein each first hollow pass through of the one or more upper guide channels is concentrically aligned with a respective second hollow pass through of the one or more lower guide channels; and wherein each guide is configured to axially move along a respective one of the one or more lower guide channels so as to move the upper member toward and/or away from the lower member.

3. The holder of claim 2, wherein the one or more biasing devices reside within the one or more lower guide channels.

4. The holder of claim 3, wherein each guide extends through a respective biasing device of the one or more biasing devices.

5. The holder of claim 1, wherein the one or more guide members remain static relative to the upper member when the upper member is moved toward and/or away from the lower member.

6. The holder of claim 1, wherein the holder retains the content within the holding gap;

wherein the holding gap has a cross-section which is linear on an upper side and an opposing lower side;

wherein a plurality of surfaces defining the upper channel and a plurality of surfaces defining the lower channel do not apply compression to the content retained therein when the holder is in a closed position; and wherein the content is a record cover, a record, or any combination thereof.

7. The holder of claim 1, wherein the second main wall of the lower member includes a portion which is a main body of the holder, wherein the main body is located between the upper channel and the lower channel, and wherein the main body has a circular planar shape which has a width greater than a width of the upper channel and the lower channel.

8. The holder of claim 1, wherein the holding gap has a height of 12.5 inches or greater to 15 inches or less when in a closed position when the upper member abuts to the lower member; and wherein the height of the holding gap is measured as the distance from the first supporting wall to the opposing second supporting wall.

9. The holder of claim 8, wherein the upper member is moveable relative to the lower member such as to increase the height of the holding gap by 0.25 inches or greater to 2 inches or less in an open position relative to the closed position.

10. The holder of claim 8, wherein the holder includes a lip gap formed as a distance between a top edge of the second lip and a bottom edge of the first lip; and wherein the lip gap is smaller than the holding gap by 0.1 inches or greater to 2 inches or less.

11. The holder of claim 1, wherein the first lip and the second lip each have a height of 0.1 inches or greater to 1 inch or less.

12. A holder for displaying a content, the holder comprising:

a) an upper member having:

i) a first main wall integral with a first supporting wall which is integral with a first lip, wherein the first main wall has a front surface which is planar and opposite a rear surface which is planar, and wherein an upper exterior surface of the first supporting wall is the uppermost surface of the upper member;

ii) an upper channel in the form of a c-channel formed by the first main wall, the first supporting wall, and the first lip and formed along a top portion of the upper member, wherein the upper channel is straight and extends laterally across an entire width of the top portion of the upper member;

iii) one or more upper guide channels projecting from the rear surface of the first main wall and each of the one or more upper guide channels having a first hollow pass through;

b) a lower member having:

i) a second main wall integral with a second supporting wall which is integral with a second lip, wherein the second main wall has a front surface which is planar and opposite a rear surface which is planar, and wherein a lower exterior surface of the second supporting wall is the lowermost surface of the lower member, wherein a portion of the second main wall forms a main body between the upper channel and a lower channel;

ii) the lower channel in the form of a c-channel formed by the second main wall, the second supporting wall, and the second lip and formed along a bottom portion of the lower member, wherein the lower channel is straight and extends laterally across an entire width of the bottom portion of the lower member;

iii) one or more lower guide channels projecting from the rear surface of the second main wall and each of the one or more lower guide channels having a second hollow pass through, wherein each second hollow pass through of the one or more lower guide channels is concentrically aligned with a respective first hollow pass through of the one or more upper guide channels of the upper member;

c) one or more guide members at least partially located within the one or more upper guide channels and the one or more lower guide channels, wherein each of the one or more guide members includes:

i) a guide located within a respective one of the one or more upper guide channels and located within a respective one of the one or more lower guide channels;

ii) a guide stop which retains the guide statically affixed within the respective one of the one or more upper guide channels;

d) one or more biasing devices within the one or more lower guide channels which provide a biasing force such as to bias the upper member toward the lower member;

wherein each guide extends through a respective biasing device of the one or more biasing devices;

wherein the lower channel is located opposite from and parallel to the upper channel;

wherein a distance from the lower channel to the upper channel forms a holding gap which has the content received therein for display;

wherein the upper member is moveable relative to the lower member such that the upper channel moves further away from the lower channel and the holding gap is increased in size;

wherein the main body has a circular planar shape which has a width greater than a width of the upper channel and the lower channel;

wherein the content is a record cover, a record, or both; and wherein the lower member includes one or more mounting features such that the lower member is configured to be statically affixed to a supporting surface which is located behind the lower member, and wherein the supporting surface is a wall of a dwelling or other building.

13. The holder of claim 12, wherein each guide is substantially rod-shaped.

14. The holder of claim 13, wherein each guide stop is affixed to or integral with a respective guide to retain each guide statically affixed within the one or more upper guide channels.

15. The holder of claim 14, wherein each guide stop is formed as a head on the respective guide and has a width larger than a width of the respective guide and a respective upper guide channel of the one or more upper guide channels.

16. The holder of claim 12, wherein the one or more upper guide channels include two upper guide channels, the one or more lower guide channels include two lower guide channels, and the one or more guide members include two guide members; and wherein the one or more mounting features include one or more openings which have one or more fasteners extending therethrough.

17. The holder of claim 12, wherein the holding gap has a height of 12.5 inches or greater to 15 inches or less when in a closed position when the upper member abuts to the lower member;

wherein the height of the holding gap is measured as the distance from the first supporting wall to the opposing second supporting wall; and wherein the upper member is moveable relative to the lower member such as to increase the height of the holding gap by 0.25 inches or greater to 2 inches or less in an open position relative to the closed position.

18. The holder of claim 12, wherein the first lip and the second lip each have a height of 0.1 inches or greater to 1 inch or less.

19. A holder for displaying a content, the holder comprising:

a) an upper member having:

i) a first main wall integral with a first supporting wall which is integral with a first lip, wherein the first main wall has a front surface which is planar and opposite a rear surface which is planar, and wherein an upper exterior surface of the first supporting wall is the uppermost surface of the upper member;

ii) an upper channel in the form of a c-channel formed by the first main wall, the first supporting wall, and the first lip and formed along a top portion of the upper member, wherein the upper channel is straight and extends laterally across an entire width of the top portion of the upper member;

iii) one or more upper guide channels projecting from the rear surface of the first main wall and each of the one or more upper guide channels having a first hollow pass through;

b) a lower member having:

i) a second main wall integral with a second supporting wall which is integral with a second lip, wherein the second main wall has a front surface which is planar and opposite a rear surface which is planar, and wherein a lower exterior surface of the second supporting wall is the lowermost surface of the lower member, wherein a portion of the second main wall forms a main body between the upper channel and a lower channel;

ii) the lower channel in the form of a c-channel formed by the second main wall, the second supporting wall, and the second lip and formed along a bottom portion of the lower member, wherein the lower channel is straight and extends laterally across an entire width of the bottom portion of the lower member;

iii) one or more lower guide channels projecting from the rear surface of the second main wall and each of the one or more lower guide channels having a second hollow pass through, wherein each second hollow pass through of the one or more lower guide channels is concentrically aligned with a respective first hollow pass through of the one or more upper guide channels of the upper member;

c) one or more guide members at least partially located within the one or more upper guide channels and located within a respective one of the one or more lower guide channels, wherein each of the one or more guide members includes:

i) a guide located within a respective one of the one or more upper guide channels and located within a respective one of the one or more lower guide channels;

ii) a guide stop which retains the guide statically affixed within the respective one of the one or more upper guide channels, wherein the guide stop is formed as a head on the guide and has a width larger than a width of the guide and a respective upper guide channel of the one or more upper guide channels;

d) one or more biasing devices within the one or more lower guide channels which provide a biasing force such as to bias the upper member toward the lower member;

wherein each guide extends through a respective biasing device of the one or more biasing devices;

wherein the lower channel is located opposite from and parallel to the upper channel;

wherein a distance from the lower channel to the upper channel forms a holding gap which has the content received therein for display;

wherein the upper member is moveable relative to the lower member such that the upper channel moves further away from the lower channel and the holding gap is increased in size;

wherein the main body has a circular planar shape which has a width greater than a width of the upper channel and the lower channel;

wherein the content is a record cover, a record, or both;

wherein the upper member and the lower member are configured to not apply compression onto the content retained within the holding gap when the holder is in a closed position;

wherein the lower member includes one or more mounting features such that the lower member is configured to be statically affixed to a supporting surface which is located behind the lower member, and wherein the supporting surface is a wall of a dwelling or other building; and wherein the holding gap has a height of 12.5 inches or greater to 15 inches or less when in the closed position when the upper member abuts to the lower member, wherein the height of the holding gap is measured as the distance from the first supporting wall to the opposing second supporting wall;

wherein the upper member is moveable relative to the lower member such as to increase the height of the holding gap by 0.25 inches or greater to 2 inches or less in an open position relative to the closed position; and wherein the first lip and the second lip each have a height of 0.1 inches or greater to 1 inch or less.

* * * * *